United States Patent [19]

Hara et al.

[11] Patent Number: 5,069,128

[45] Date of Patent: Dec. 3, 1991

[54] DEVICE FOR CLEANING A CYLINDER OF A PRINTING MACHINE

[75] Inventors: Akira Hara; Mitsunori Sukigara, both of Tokyo; Toshisaburo Takagi, Urawa, all of Japan

[73] Assignee: B-J Trading Limited, Tokyo, Japan

[21] Appl. No.: 333,032

[22] Filed: Apr. 4, 1989

[30] Foreign Application Priority Data

Jun. 30, 1988 [JP] Japan ..... 63-163657

[51] Int. Cl.[5] ..... B41F 35/00; B41L 41/00

[52] U.S. Cl. ..... 101/425; 15/256.51; 355/300

[58] Field of Search ..... 101/425; 15/104.93, 15/104.94, 256.51; 355/300, 283

[56] References Cited

U.S. PATENT DOCUMENTS

| | | | |
|---|---|---|---|
| 4,064,061 | 12/1977 | Henry | 15/104.93 X |
| 4,074,627 | 2/1978 | Eck et al. | 101/425 |
| 4,344,361 | 8/1982 | MacPhee et al. | 101/425 |
| 4,389,936 | 6/1983 | Jaffa et al. | 101/425 X |
| 4,666,621 | 5/1987 | Clark et al. | 15/104.93 X |
| 4,673,523 | 6/1987 | Smith et al. | 15/104.93 X |
| 4,926,218 | 5/1990 | Fukso | 355/300 X |
| 4,939,552 | 7/1990 | Nakanishi | 355/300 |

*Primary Examiner*—Edgar S. Burr
*Assistant Examiner*—Moshe I. Cohen
*Attorney, Agent, or Firm*—Morgan & Finnegan

[57] ABSTRACT

A device for cleaning a cylinder of a printing machine of the type which uses a cleaning cloth stretched between a cloth supply roll and a cloth take-up roll and adapted to be brought into contact with the outer periphery of a cylinder in a printing machine by pressurizing means, the cleaning cloth being impregnated with a cleaning liquid before it is set in the device. Needing no cleasning liquid supply system or liquid supply control means, the device can be realized in a very simple and compact form, which allows for easy maintenance.

14 Claims, 4 Drawing Sheets

DEVICE FOR CLEANING A CYLINDER OF A PRINTING MACHINE

BACKGROUND OF THE INVENTION

1. Field of the Invention

This invention relates to a device for cleaning the outer peripheral surface of a cylinder in a printing machine such as the blanket cylinder of an offset press or the plate cylinder of a gravure press, and in particular, to a compact and simplified device for cleaning a cylinder of a printing machine which includes no mechanism for supplying cleaning liquid to a cleaning cloth employed.

2. Description of the Prior Art

In a conventional device for cleaning a cylinder of a printing machine of the type which uses a cleaning cloth, the cleaning cloth is wound around a cloth supply roll, and is continuously or intermittently taken up by a cloth take-up roll. A pressure pad serving as pressurizing means is provided between these rolls. In cleaning a cylinder such as a blanket cylinder, this pressure pad is pressed against the cylinder to wipe its surface. Simultaneously, a cleaning liquid conveyed through a header and a spray bar is supplied to the cleaning cloth, the supply of liquid being timed to start somewhat earlier than the pressing of the cloth against the cylinder.

The above-described conventional cylinder cleaning device for the printing machine requires complicated control means for measuring the amount of liquid to be supplied and controlling the liquid supply timing. In addition, a relatively large space has to be secured to enable a cleaning liquid tank, etc. to be installed therein, resulting overall in a rather expensive device.

SUMMARY OF THE INVENTION

It is accordingly an object of this invention to provide a cylinder cleaning device for a printing machine which includes no mechanism for supplying cleaning liquid to a cleaning cloth.

In accordance with this invention, the above object can be attained by using a cleaning cloth that has been previously impregnated with a cleaning liquid.

In order to attain the above object, this invention provides a device for a cleaning cylinder of a printing machine comprising a cloth supply roll, a cloth take-up roll, a strip of cleaning cloth stretched between the cloth supply roll and the cloth take-up roll, and means for pressing the cleaning cloth against the outer peripheral surface of a cylinder in a printer, the cleaning cloth being impregnated with a cleaning liquid before it is set in the device.

The cleaning cloth consists of a woven fabric or a non-woven fabric made from a synthetic resin, natural fibers or wood pulp, etc.

The cleaning cloth may be a composite material consisting of at least two materials selected from among synthetic resin, natural fibers and wood pulp, etc.

In any case, the cleaning liquid with which the cleaning cloth is impregnated may, for example, be a mixture consisting of ca. 90% by volume of diethylene glycol and ca. 10% by volume of polyethylene glycol.

In order to prevent any transpiration of the cleaning liquid, the cleaning cloth is lodged in an airtight cylindrical case which supports the cloth supply roll at its ends and which has an opening which is sealed before use but which serves in use as a slit through which the cleaning cloth is pulled. Thus, the cleaning cloth is supplied in a cassette form.

Further, the entire back surface of a cleaning cloth impregnated with cleaning liquid may be laminated with a very thin film which is impermeable to air.

Thus, this invention employs a cleaning cloth which is impregnated with a cleaning liquid before it is set in the cleaning device, so that it is not necessary to provide a cleaning liquid supply system in the device, which eliminates the need for a control means and the space for accommodating it. Accordingly, a substantial reduction in cost can be attained.

Transpiration of the cleaning liquid can be prevented by lodging the cleaning cloth impregnated therewith in a cylindrical case so that it can be supplied in a cassette form, or by laminating a very thin film which is impermeable to air over the cloth.

The objects, advantages and novel features of this invention will be described below in detail with reference to the accompanying drawings.

DETAILED DESCRIPTION OF THE PREFERRED EMBODIMENTS

Embodiments of this invention will now be described with reference to FIGS. 1 to 5.

Figure 1:
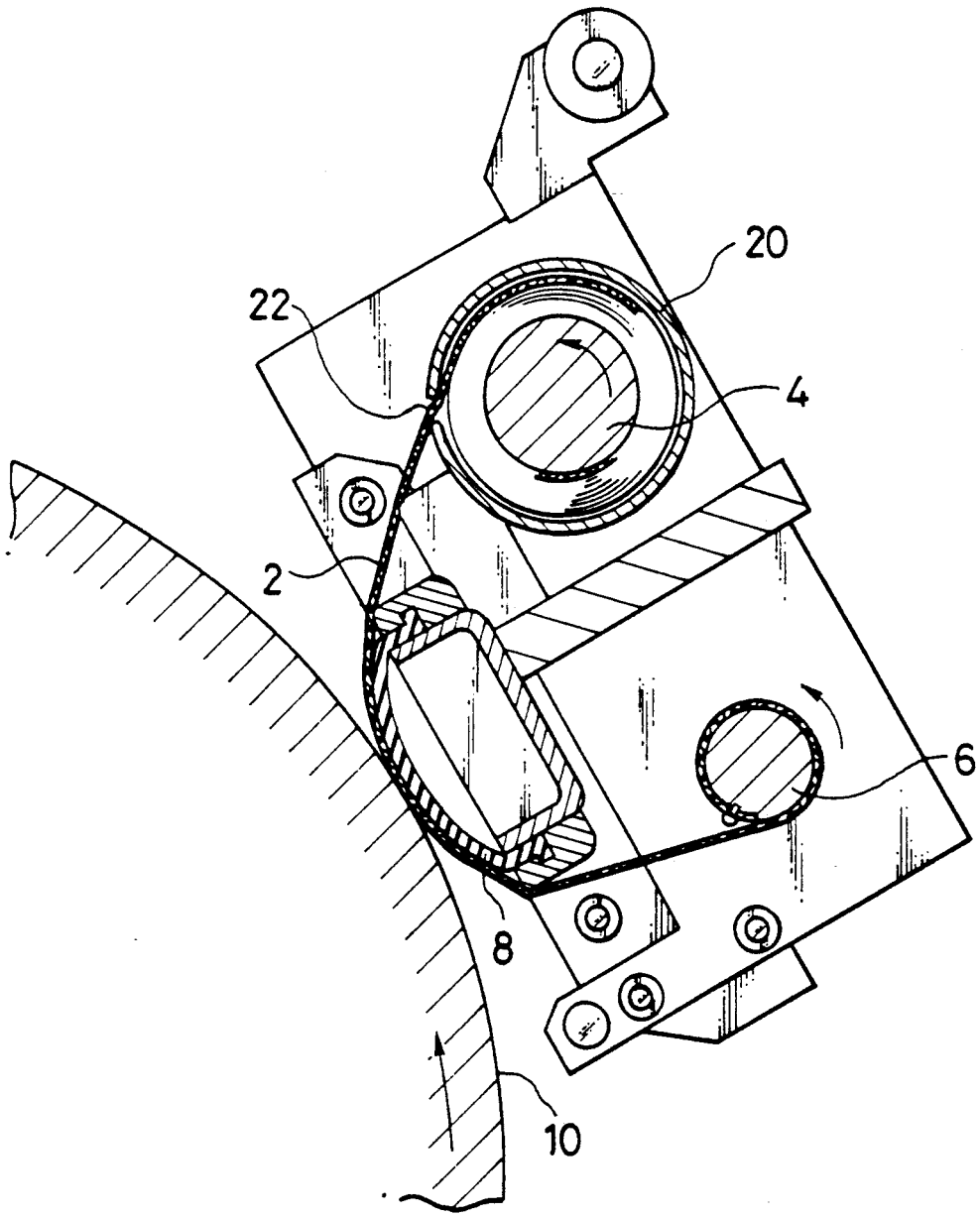
FIG. 1 is a side sectional view of an embodiment of the device of this invention for cleaning a cylinder of a printing machine.
Figure 2:
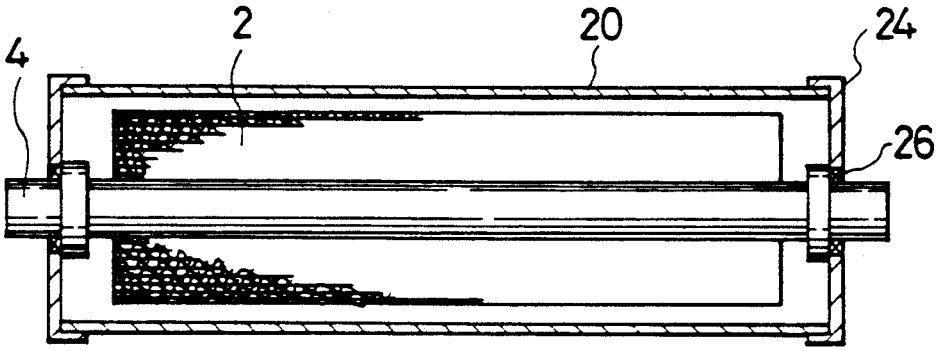
FIG. 2 is a sectional view as observed in the axial direction of an embodiment of a cleaning cloth lodged in a cylindrical case so as to be supplied in a cassette form.
Figure 3:
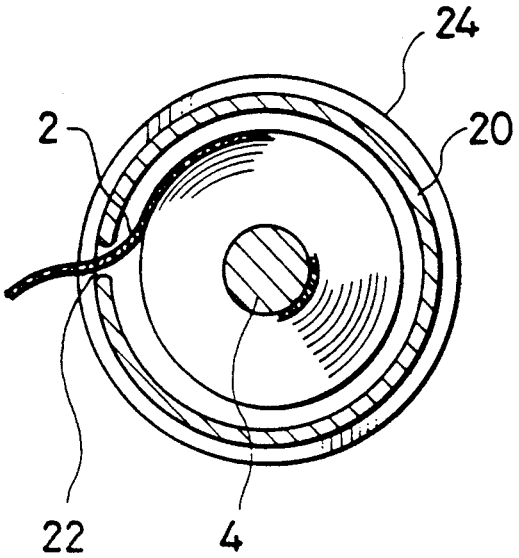
FIG. 3 is a side sectional view of the embodiment shown in FIG. 2.

As shown in FIGS. 1 to 3, a cleaning cloth 2 is lodged in an airtight cylindrical case 20, and is attached to the printing machine in the form of a cassette.

The case 20 includes a slit 22 which is closed airtightly by a seal (not shown) before use and which in use is adapted to allow the cleaning cloth to be pulled out. Provided at the ends of the case 20 are covers 24. A cloth supply roll 4 is disposed within the case 20 with its ends passing through the covers 24 which serve as the bearings thereof through the intermediary of seals 26 and cloth therefrom is taken up on a take-up roll 6, as shown in FIG. 1.

Figure 6:
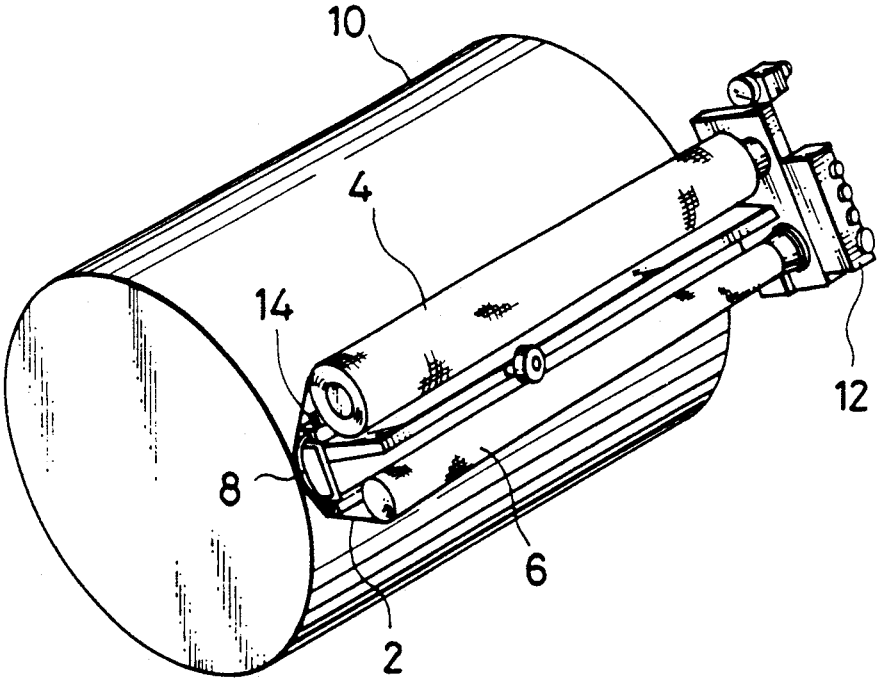
FIG.6 PRIOR ART
FIG. 6 is a perspective view of a conventional device for cleaning a cylinder.

In contrast to the conventional device shown in FIG. 6, the embodiment shown in FIG. 1 has no header 12 or spray bar 14. Neither does it require any complicated control means for measuring flow rate and controlling the liquid supply timing, which means has been indispensable in prior art cleaning devices. Furthermore, the relatively large space needed in the prior art for installing a cleaning liquid tank, etc. is no longer necessary. Accordingly, a substantial reduction in cost can be expected.

Figure 4:
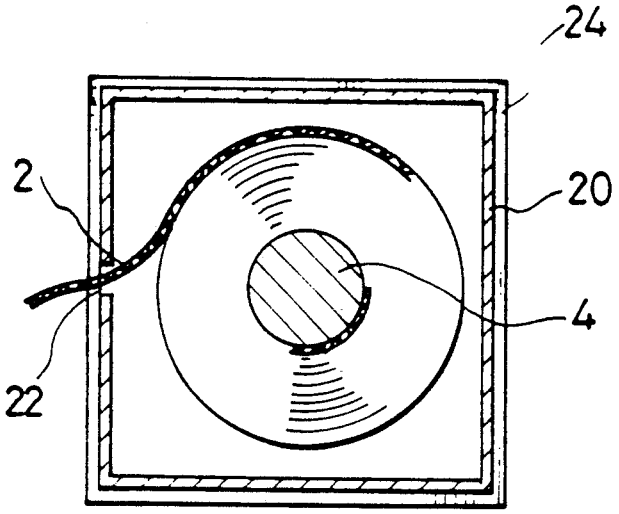
FIG. 4 is a side sectional view of an embodiment wherein the cleaning cloth is lodged in a square case.

The cross-sectional configuration of the case is not limited to the circular one illustrated. It can be square or polygonal, as shown in FIG. 4. An angular cross-sectional configuration is advantageous in that the slit 22 can be accurately positioned with respect to the cylinder 10 without any need for a special cutout or the like.

Instead of lodging it in the airtight case 20, the loss of cleaning liquid from the cleaning cloth through transpiration may alternatively be prevented by laminating its entire back surface with a very thin film 30 which is impermeable to air before it is wound around the cloth supply roll 4. Any transpiration of the cleaning liquid from the edges of the strip of cleaning cloth 2 can be prevented by, for example, providing flanges on the cloth supply roll 4.

Figure 5:
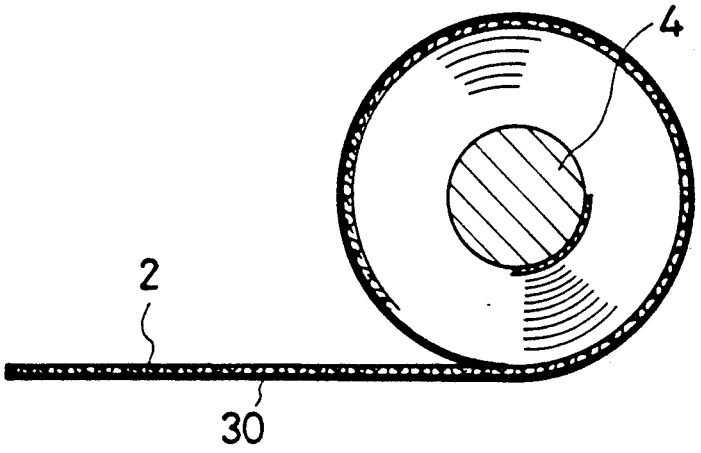
FIG. 5 is a side sectional view of an embodiment wherein the cleaning cloth is laminated with a very thin film which is impermeable to air.

It may be mentioned that the cloth supply roll 4 in the embodiments shown in FIGS. 3 to 5 can, of course, be made hollow.

The material of the cleaning cloth 2 is preferably a non-woven fabric made from a synthetic resin or wood pulp, or a composite material of a synthetic resin and wood pulp.

The cleaning liquid with which the cleaning cloth is impregnated may consist of a mixture of ca. 90% by volume of diethylene glycol and ca. 10% by volume of polyethylene glycol.

All of the above-described embodiments provide a cylinder cleaning device with a simplified structure. In addition, the amount of cleaning liquid remaining in the tank does not have to be taken into account, which lessens the burden imposed on operators during both operation and maintenance.

Thus, in accordance with this invention, the cleaning cloth is impregnated with a cleaning liquid before it is set in the cleaning device, so that no cleaning liquid supply system has to be provided in the device. This eliminates the need for a control means or the space that would be needed for accommodating such a system.

In addition, the cleaning cloth impregnated with a cleaning liquid is lodged in a cylindrical case for supply in a cassette form, or is laminated with a very thin film which is impermeable to air, thereby preventing any transpiration of the cleaning liquid and facilitating handling of the cleaning cloth.

I claim:

1. A device for cleaning a cylinder of a printing machine, comprising:

an airtight cylindrical case, a cover and seal means at each end of said case, a cleaning cloth supply roll contained in said case with its ends passing through said covers at said seal means;

a cleaning cloth take-up roll;

a strip cleaning cloth which is impregnated with cleaning liquid before being attached to said cleaning cloth supply roll, which is lodged in said case for supply and which after breaking the airtightness of said case is stretched between said cleaning cloth supply roll and said cleaning cloth take-up roll; and means for pressing said cleaning cloth against the outer periphery of the cylinder of the printing machine.

2. A device as claimed in claim 1, wherein the cleaning cloth consists of a woven fabric made from a synthetic resin.

3. A device as claimed in claim 1, wherein the cleaning cloth consists of a non-woven fabric made from a synthetic resin.

4. A device as claimed in claim 1, wherein the cleaning cloth is a woven fabric made from a composite material composed of at least two types of materials selected from the group consisting of a synthetic resin and natural fibers selected from the group consisting of cotton fiber, hemp fiber, woolen fiber and wood pulp.

5. A device as claimed in claim 1, wherein the cleaning cloth is impregnated with a cleaning liquid which consists of a mixture of ca. 90% by volume of diethylene glycol and ca. 10% by volume of polyethylene glycol.

6. A device as claimed in claim 1, wherein the cleaning cloth is lodged in a case and in use is pulled out through a slit-like opening provided in said case.

7. A device as claimed in claim 6, wherein the case comprises a closed side-wall section having a slit-like opening equipped with a seal to enable the cleaning cloth wound around the cleaning cloth supply roll to be pulled out in use, and end covers having a configuration in conformity with that of said side-wall section and respective openings equipped with seals and which is adapted to be penetrated by the ends of said cleaning cloth supply roll.

8. A device as claimed in claim 6, wherein the side-wall section of the case has a circular cross-sectional configuration.

9. A device as claimed in claim 6, wherein the side-wall section of the case has a square cross-sectional configuration.

10. A device as claimed in claim 6, wherein the side-wall section of the case has a polygonal cross-sectional configuration.

11. A device as claimed in claim 1, wherein the entire back surface of the strip of cleaning cloth is laminated with very thin film which is impermeable to air.

12. A device as claimed in claim 1, wherein the cleaning cloth consists of a woven fabric made from a natural fiber selected from the group consisting of cotton fiber, hemp fiber, woolen fiber and wood pulp.

13. A device as claimed in claim 1, wherein the cleaning cloth consists of a non-woven fabric made from a natural fiber selected from the group consisting of cotton fiber, hemp fiber, woolen fiber and wood pulp.

14. A device as claimed in claim 1, wherein the cleaning cloth is a non-woven fabric made from a composite material composed of at least two types of materials selected from the group consisting of a synthetic resin and natural fibers selected from the group consisting of cotton fiber, hemp fiber, woolen fiber and wood pulp.

* * * * *